US010662492B2

(12) United States Patent
Kubo

(10) Patent No.: US 10,662,492 B2
(45) Date of Patent: May 26, 2020

(54) ABRASION-RESISTANT STEEL MATERIAL EXCELLENT IN FATIGUE CHARACTERISTICS AND METHOD FOR MANUFACTURING SAME

(71) Applicant: NISSHIN STEEL CO., LTD., Tokyo (JP)

(72) Inventor: Hironori Kubo, Hiroshima (JP)

(73) Assignee: NIPPON STEEL NISSHIN CO., LTD., Tokyo (JP)

( * ) Notice: Subject to any disclaimer, the term of this patent is extended or adjusted under 35 U.S.C. 154(b) by 859 days.

(21) Appl. No.: 14/899,277

(22) PCT Filed: Jun. 27, 2013

(86) PCT No.: PCT/JP2013/067732
§ 371 (c)(1),
(2) Date: Dec. 18, 2015

(87) PCT Pub. No.: WO2014/207879
PCT Pub. Date: Dec. 31, 2014

(65) Prior Publication Data

US 2016/0138125 A1 May 19, 2016

(51) Int. Cl.
*C21D 9/46* (2006.01)
*C22C 38/12* (2006.01)
(Continued)

(52) U.S. Cl.
CPC ..... *C21D 9/46* (2013.01); *B22D 11/00* (2013.01); *C21D 1/19* (2013.01); *C21D 1/25* (2013.01);
(Continued)

(58) Field of Classification Search
CPC ..... C22C 38/04; C22C 38/12; C21D 9/46
(Continued)

(56) References Cited

U.S. PATENT DOCUMENTS

2012/0024077 A1 2/2012 Fujita et al.

FOREIGN PATENT DOCUMENTS

JP 62-142726 6/1987
JP 63-169359 7/1988
(Continued)

OTHER PUBLICATIONS

Murakami et al., "Critical Review . . . Its Applications", Journal of the Iron & Seel Institute of Japan 1993. 12, vol. 79, No. 12, pp. 1380-1385.

*Primary Examiner* — Weiping Zhu
(74) *Attorney, Agent, or Firm* — Clark & Brody LP

(57) ABSTRACT

An abrasion-resistant steel material excellent in fatigue characteristics having a composition (in mass %) comprising 0.30 to 0.90% of C, 0.05 to 1.00% of Si, 0.10 to 1.50% of Mn, 0.003 to 0.030% of P, 0.001 to 0.020% of S, from 0.10 to 0.70% of Nb, and containing depending on necessity one or more of 1.50% or less of Cr, 0.50% or less of Mo, 0.50% or less of V, 2.00% or less of Ni, 0.10% or less of Ti, and 0.0050% or less of B, the balance Fe and unavoidable impurities, a metallic structure after a temper heat treatment having a Nb-containing carbide dispersed therein, the Nb-containing carbide particles having a particle diameter of 1.0 mm or more that is controlled to 200 particles per $mm^2$ or more, and a maximum particle diameter Dmax of Nb-containing carbide particles in $10^3$ $mm^3$ that is controlled to 18.0 mm or less.

3 Claims, 1 Drawing Sheet

(51) Int. Cl.

| | |
|---|---|
| ***C22C 38/54*** | (2006.01) |
| ***C21D 1/25*** | (2006.01) |
| ***C21D 8/02*** | (2006.01) |
| ***C21D 1/19*** | (2006.01) |
| ***B22D 11/00*** | (2006.01) |
| ***C21D 6/00*** | (2006.01) |
| ***C22C 38/00*** | (2006.01) |
| ***C22C 38/02*** | (2006.01) |
| ***C22C 38/04*** | (2006.01) |
| ***C22C 38/14*** | (2006.01) |
| ***C22C 38/22*** | (2006.01) |
| ***C22C 38/24*** | (2006.01) |
| ***C22C 38/26*** | (2006.01) |

(52) U.S. Cl.
CPC ..... *C21D 6/002* (2013.01); *C21D 6/005* (2013.01); *C21D 6/008* (2013.01); *C21D 8/021* (2013.01); *C22C 38/001* (2013.01); *C22C 38/002* (2013.01); *C22C 38/02* (2013.01); *C22C 38/04* (2013.01); *C22C 38/12* (2013.01); *C22C 38/14* (2013.01); *C22C 38/22* (2013.01); *C22C 38/24* (2013.01); *C22C 38/26* (2013.01); *C22C 38/54* (2013.01); *C21D 8/0226* (2013.01); *C21D 8/0236* (2013.01); *C21D 2211/002* (2013.01); *C21D 2211/004* (2013.01); *C21D 2211/005* (2013.01); *C21D 2211/008* (2013.01)

(58) Field of Classification Search
USPC ..... 148/541
See application file for complete search history.

(56) References Cited

FOREIGN PATENT DOCUMENTS

| | | | |
|---|---|---|---|
| JP | 01-142023 | | 6/1989 |
| JP | 2010-216008 | | 9/2010 |
| JP | 2010216008 A | * | 9/2010 |
| JP | 2010-248630 | | 11/2010 |
| JP | 2013-136820 | | 7/2013 |

* cited by examiner

[Fig.1]
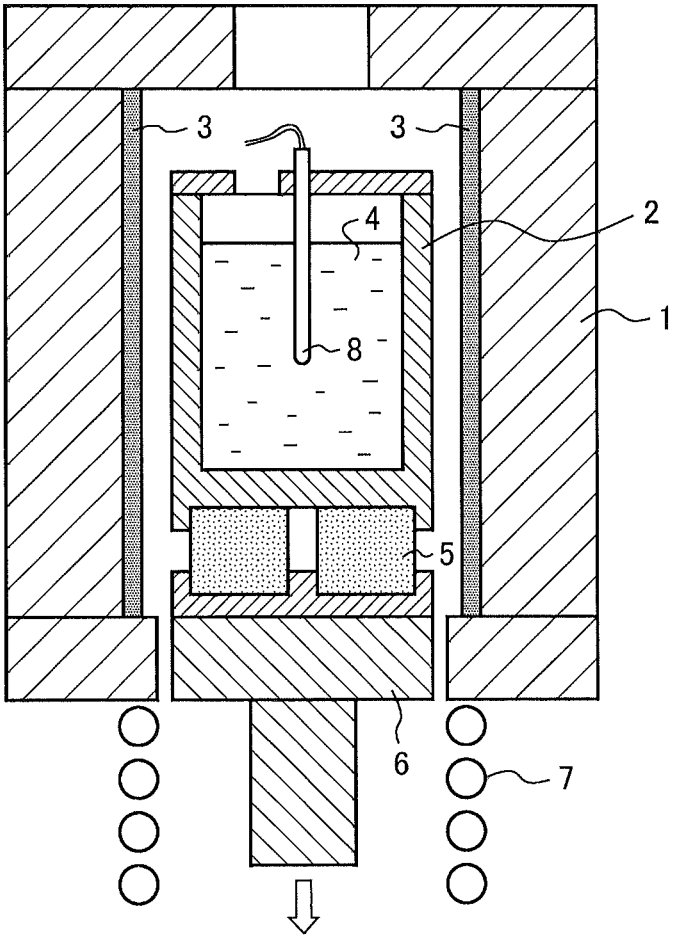
[Fig.2]
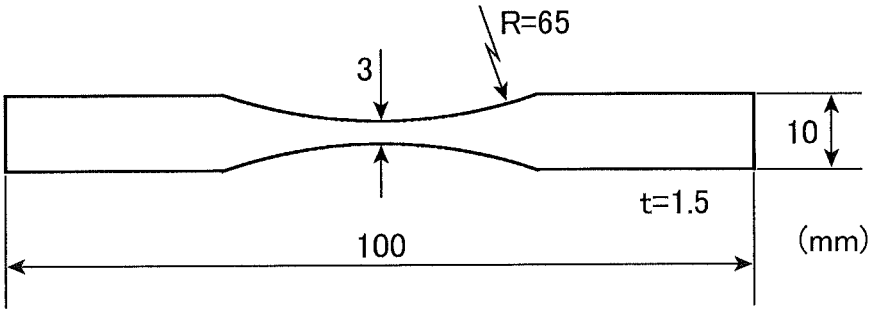

ABRASION-RESISTANT STEEL MATERIAL EXCELLENT IN FATIGUE CHARACTERISTICS AND METHOD FOR MANUFACTURING SAME

TECHNICAL FIELD

The present invention relates to an abrasion-resistant steel material having a hard carbide dispersed therein that is particularly improved in fatigue characteristics, and a method for manufacturing the same.

BACKGROUND ART

Abrasion resistance is required for an automobile component, a power transmission component for industrial machines, such as a chain components and a gear wheel, and a cutting tool, such as a rim saw and a band saw, used for cutting wood, grass or the like. In general, the abrasion resistance of a steel material is enhanced by increasing the hardness thereof. Accordingly, the component where the abrasion resistance is important is generally produced with a steel material that has been tempered to have higher hardness through tempering performed at a low temperature after quenching, and a steel material having a large content of an alloy element, such as carbon. Accordingly, there is a close relationship between the hardness and the abrasion resistance of the steel material, and as a measure for imparting abrasion resistance to a steel material, a measure for enhancing the hardness thereof has been ordinarily employed.

For example, PTLs 1 to 3 describe that in a steel having a C content of approximately 0.2% or less, the content of the alloy element is set to a higher value to enhance the hardness through solid solution strengthening, precipitation strengthening and the like. However, associated with the increasing demand level of abrasion resistance in recent years, the sufficiently satisfactory abrasion resistance often cannot be obtained only by increasing the hardness. Furthermore, the increase of the content of the alloy element as in PTLs 1 to 3 lowers the productivity and the workability of the material as a result, which causes a problem of increase in production cost.

On the other hand, it is important to prevent a power transmission component and a cutting tool from being broken in use, from the standpoint of safety. For preventing the breakage, it is necessary to ensure sufficiently the toughness of the steel material used for the component. For enhancing the toughness of the steel material, in general, the suppression of the tempered hardness is said to be effective. However, the abrasion resistance is generally lowered simultaneously along with the suppression of the tempered hardness. That is, the abrasion resistance and the toughness of the steel material are in a trade-off relationship.

The applicant has made various investigations on a technique capable of achieving both the abrasion resistance and the toughness simultaneously, and describes the practical measure in PTL 4. The measure is to enhance the abrasion resistance by utilizing dispersion of a Nb-containing carbide without the use of a Ti based carbide, which is a factor decreasing the toughness. On casting a Nb-containing steel, the period of time for retaining the cast material at a high temperature is made sufficiently long, so as to deposit the sufficient amount of the Nb-containing carbide excessively, and a part of the Nb-containing carbide re-dissolves into a solid solution through the subsequent heat treatment, thereby controlling the precipitated amount of the Nb-containing carbide. According to the procedure, the resistance to abrasive abrasion can be enhanced while maintaining the toughness, which is effective for the enhancement of the lifetime of the high strength mechanical member. The abrasive wear is such a mode of wear that the surface of the material is scraped off with the unevenness on the frictional surface of the counter material or with the foreign matters intervening between the frictional surfaces.

CITATION LIST

Patent Literature

PTL 1: JP-A-62-142726
PTL 2: JP-A-63-169359
PTL 3: JP-A-1-142023
PTL 4: JP-A-2010-216008

Non-Patent Literature

NPL 1: Yukitaka Murakami, "Metal Fatigue: Effects of Small Defects and Inclusions", Chapter A3 "Prediction of $\sqrt{area}_{max}$ of Maximum Inclusion contained in Unit Volume", Yokendo Co., Ltd, 1993.

SUMMARY OF INVENTION

Technical Problem

The factors that largely influences the lifetime of the high strength steel material, such as a power transmission component and a cutting tool, include the abrasion resistance and the toughness, and the decrease of the lifetime due to the factors has been largely suppressed by the technique described in PTL 4. For further enhancing the lifetime of the high strength steel material having been improved in abrasion resistance and toughness, it is effective to consider the metal fatigue. The technique described in PTL 4 has not sufficiently addressed the metal fatigue, and there is room of improvement in the enhancement of the lifetime.

As a result of the researches by the present inventors, there are some cases where the fatigue characteristics are slightly decreased in the steel material having a Nb-containing carbide dispersed therein by utilizing the technique of PTL 4. As a result of the detailed researches on the causes thereof, it has been found that the re-dissolution of the coarse Nb-containing carbide into a solid solution is insufficiently performed due to the measure of forming the Nb-containing carbide excessively on casting, and the Nb-containing carbide may function as a starting point of fatigue failure.

The invention is to provide a measure for stably improving fatigue characteristics in a technique of imparting abrasion resistance by utilizing a Nb-containing carbide.

Solution to Problem

The inventors have made detailed investigations on the influence of the diameter of the Nb-containing carbide on the abrasion resistance and the fatigue characteristics of a high strength steel material containing Nb. As a result, it has been found that particles having a large diameter of the Nb-containing carbide adversely affect the fatigue characteristics. In a high strength steel material having been tempered to a hardness in a 500 to 650 HV level, it has been confirmed that the fatigue characteristics may be considerably improved by eliminating excessively large Nb-containing carbide particles, so as to make a maximum particle diameter Dmax of 18.0 μm or less, as described later. With respect to the abrasion resistance, on the other hand, the satisfactory level thereof may be maintained by dispersing a Nb-containing carbide having a suitable particle diameter, as similar to the technique of PTL 4. It has also been found that such a metallic structure state can be achieved by strictly controlling the cooling rate on casting and the heating temperature on heating the cast material. The invention has been completed based on the knowledge.

The aforementioned objects are achieved by an abrasion-resistant steel material excellent in fatigue characteristics having a chemical composition comprising from 0.30 to 0.90% of C, from 0.05 to 1.00% of Si, from 0.10 to 1.50% of Mn, from 0.003 to 0.030% of P, from 0.001 to 0.020% of S, and from 0.10 to 0.70% of Nb, and containing depending on necessity one or more kind of 1.50% or less of Cr, 0.50% or less of Mo, 0.50% or less of V, 2.00% or less of Ni, 0.10% or less of Ti, and 0.0050% or less of B, all in terms of percentage by mass, with the balance of Fe and unavoidable impurities; having a metallic structure after a temper heat treatment having a Nb-containing carbide dispersed therein; and having a number of Nb-containing carbide particles having a particle diameter of 1.0 μm or more that is controlled to 200 particles per $mm^2$ or more, and a maximum particle diameter Dmax of Nb-containing carbide particles in $10^3$ $mm^3$ estimated by an extreme value statistics method that is controlled to 18.0 μm or less, assuming that a square root of an area of each of Nb-containing carbide particles found by observing a cross sectional structure is designated as the particle diameter of the particle.

The maximum particle diameter Dmax is determined by performing a statistical process according to NPL 1 where the inclusion in NPL 1 is substituted by the Nb-containing carbide. The temper heat treatment is a treatment for hardening a metallic structure through a transformation treatment including a process of quenching from the austenite temperature range to a temperature range that is lower than the $A_1$ transformation temperature, and representative examples thereof include a quench and tempering treatment and an austempering treatment.

As a method for manufacturing the high-strength steel material excellent in fatigue characteristics, such a method may be employed that contains providing an abrasion-resistant steel material having been finally subjected to a temper heat treatment from a steel material having been subjected to casting and a cast material heat treatment, in which a heating temperature T (° C.) in the cast material heat treatment is determined corresponding to a C content and a Nb-content in the steel in such a manner that a G value determined by the following expression (1) is 0.53 or more, and a casting condition is controlled in such a manner that an average cooling rate (° C. per minute) from 1,500° C. to 1,000° C. in a center portion of the cast material on casting is the G value or more:

$$G \text{ value} = 0.39 \exp(3.94x) \quad (1)$$

wherein $x = Nb - 10^y / C$ $y = 3.42 - 7{,}900/(T+273)$

C represents the C content (% by mass) in the steel, Nb represents the Nb content (% by mass) in the steel, and T represents the heating temperature (° C.) in the cast material heat treatment.

The term "cast material" in the present specification includes an ingot by an ingot-making method and a slab by a continuous casting method. The cast material heat treatment may be performed, for example, in a process of manufacturing a sheet material through continuous casting and hot rolling, by utilizing the heat on hot rolling.

Advantageous Effects of Invention

According to the invention, a high-strength steel material imparted with abrasion resistance with a Nb-containing carbide (particularly one having been tempered to have a hardness in a 500 to 650 HV level) may be significantly improved in fatigue characteristics. The breakage of the steel material due to decrease of the toughness may also be suppressed since the abrasion resistance is imparted without the use of a Ti based carbide, which is a factor decreasing the toughness. Accordingly, the invention contributes to the enhancement of the reliability and the enhancement of the lifetime of an automobile component, a power transmission component for industrial machines, such as a chain components and a gear wheel, and a cutting tool, such as a rim saw and a band saw.

BRIEF DESCRIPTION OF DRAWINGS

FIG. 1 is an illustration schematically showing the structure of the experimental apparatus capable of controlling the cooling rate on solidification of a molten steel.

FIG. 2 is an illustration schematically showing the shape of the fatigue test piece.

DESCRIPTION OF EMBODIMENTS

Chemical Composition

In the present specification, percentage relating to the component elements of the steel means percentage by mass unless otherwise indicated.

C is an element that is important for ensuring the strength and the abrasion resistance, and the invention is directed to a steel having a C content of 0.30% or more. The C content is preferably 0.32% or more, and more preferably more than 0.45%. However, the increase of the C content is liable to form coarse iron eutectic carbide (cementite) in the casting process, which may be a factor of deteriorating the material characteristics, such as the fatigue characteristics. The C content is restricted to 0.90% or less, and preferably 0.85% or less.

Si is effective for deoxidization of molten steel, and also has a function of increasing the temper softening resistance. For sufficiently exhibiting these functions, the Si content is 0.05% or more. However, an excessive Si content may be a factor of impairing the productivity due to hardening of the cold-rolled sheet, and the Si content is in a range of 1.00% or less.

Mn is an element that enhances the quenching property, and for providing the function, the content thereof is 0.10% or more. However, a large Mn content may impair the productivity due to hardening of the hot-rolled sheet and the cold-rolled sheet, and the Mn content is restricted to 1.50% or less.

P may be segregated at the austenite grain boundaries on quenching to decrease the grain boundary strength, and thus may be a factor of deteriorating the fatigue characteristics and the toughness, and thus the P content is restricted to 0.030% or less. However, excessive dephosphorization may increase the load on steel manufacture, and thus the P content may be controlled to a range of 0.003% or more.

S forms MnS in the steel, which may be a starting point of impact fracture and fatigue failure, and may be a factor of deteriorating the fatigue characteristics and the toughness, and thus the S content is restricted to 0.020% or less. However, excessive desulfurization may increase the load on steel manufacture, and thus the S content may be controlled to a range of 0.001% or more.

Nb is precipitated as a Nb-containing carbide having high hardness in the steel during the cooling process after casting, and contributes to the enhancement of the abrasion resistance, particularly the resistance to abrasive wear. Furthermore, Nb in the form of a solid solution refines the crystal grains on quenching and contributes to the enhancement of the toughness. For sufficiently exhibiting these functions, a Nb-content of 0.10% or more is necessarily ensured, and a Nb-content of 0.20% or more is more preferred. In the case where the Nb content is increased, on the other hand, the Nb-containing carbide thus precipitated is liable to be coarse, and there are cases where the desired metallic structure condition where coarse Nb-containing carbide particles are eliminated is not achieved. The fatigue characteristics may not be improved in these cases. As a result of various investigations, the Nb content is desirably 0.70% or less. The Nb content may be controlled to 0.60% or less, or 0.50% or less.

Cr is effective for the enhancement of the quenching property as similar to Mn. Cr also has a function of preventing the carbide from becoming coarse on annealing and thus is effective for the improvement of the impact value (toughness). Accordingly, Cr may be contained depending on necessity. For sufficiently exhibiting the functions, it is more effective to ensure a Cr content of 0.10% or more. However, an excessive amount of Cr added may increase the amount of the undissolved carbide and may considerably deteriorates the toughness in some cases, and thus in the case where Cr is added, the amount thereof is in a range of 1.50% or less.

Both Mo and V are elements that are effective for the enhancement of the toughness, and may be added depending on necessity. It is more effective to ensure the content of 0.10% or more for Mo and 0.10% or more for V. However, Mo and V are expensive elements, and excessive addition thereof may cause increase of the cost. In the case where one kind or two kinds of Mo and V are added, the content thereof may be in a range of 0.50% or less for both Mo and V.

Ni is effective for the enhancement of the quenching property and may be added depending on necessity. In this case, it is effective to ensure a Ni content of 0.10% or more. However excessive addition of Ni may cause increase of the cost, and in the case where Ni is added, the content thereof may be in a range of 2.00% or less.

Ti forms a Ti-containing carbide having high hardness in the steel after casting as similar to Nb, and contributes to the enhancement of the abrasion resistance, and furthermore, Ti that re-dissolves into a solid solution after casting refines the crystal grains on quenching and contributes to the enhancement of the toughness. Ti has a large bonding force to N and thus prevents BN from being formed in the case where B is added, and thus the addition of Ti is advantageous for exhibiting the function of B of improving the quenching property. In the invention, accordingly, Ti may be added depending on necessity. For sufficiently exhibiting these functions, it is effective to ensure a Ti content of 0.01% or more. However, according to the investigations by the inventors, it has been found that a large amount of the Ti-containing carbide present in the steel material is liable to cause the deterioration of the toughness. As a result of various investigations, in the case where Ti is added, it is important that the content thereof is in a range of 0.10% or less.

B is an element that is effective for the enhancement of the quenching property and may be added depending on necessity. For sufficiently exhibiting the quenching property enhancing function, it is effective to ensure a B content of 0.0005% or more. However, the function may be saturated at approximately 0.0050%, and in the case where B is added, the content thereof is in the range of 0.0050% or less.

Metallic Structure

In the invention, a Nb-containing carbide is utilized for significantly enhancing the abrasion resistance. The Nb-containing carbide referred in the present specification is a carbide that contains NbC as a major component. This type of carbide is very hard, and the abrasion resistance (particularly the resistance to abrasive wear) is significantly enhanced by dispersing the Nb-containing carbide having a suitable size in the matrix. Whether or not the precipitated particles observed in the steel correspond to the Nb-containing carbide may be determined by microscopic analysis by EDX or the like. A composite carbide containing Nb and Ti may be formed in the case where Ti is added, and such a composite carbide also corresponds to the Nb-containing carbide.

The inventors describe in PTL 4 that in the case where a Nb-containing carbide having a particle diameter (circle equivalent diameter) of 1 μm or more are present in a density of from 200 to 1,000 per $mm^2$ in the matrix of the metallic structure having been subjected to a temper heat treatment, the abrasion resistance is significantly enhanced, and the problem of impairing the toughness is also avoided. As the measure for dispersing a large amount of the Nb-containing carbide particles having a relatively large size, such a method is used that coarse Nb-containing carbide particles are precipitated on casting and then re-dissolves into a solid solution. In this measure, however, the Nb-containing carbide particles having an excessive size tend to remain and function as a starting point of fatigue failure, and thus it is difficult to improve the fatigue characteristics stably. The lifetime of the material may be determined by the fatigue failure in some cases, and the fatigue characteristics have been demanded to be improved for the enhancement of the lifetime of the high-strength material.

For preventing the fatigue failure from occurring, such a structure state is to be provided that the Nb-containing carbide particles having an excessive size, which cause the fatigue failure, do not remain therein. For providing the structure state, it is effective to define the maximum particle diameter of the Nb-containing carbide that is allowed to be present. However, even in the case where a coarse Nb-containing carbide that is considered to be a starting point of fatigue failure is not found in some observation view fields, there are many cases where the fatigue characteristics cannot be sufficiently improved, and it has been difficult to define quantitatively the structure state that is capable of stably improving the fatigue characteristics. As the cause of the phenomenon, it is considered that when only a small number of a coarse Nb-containing carbide is present in any place other than the observation view fields, the coarse Nb-containing carbide functions as a starting point of fatigue failure.

As a result of detailed investigations made by the inventors, it has been found that the extent of improvement of the fatigue characteristics of a high-strength steel material having the aforementioned composition range having been tempered to have hardness in a level of from 500 to 650 HV can be precisely determined by the maximum particle diameter Dmax of the Nb-containing carbide particles in $10^3$ $mm^3$ estimated by an extreme value statistics method. Specifically, a statistical process according to NPL 1 is performed by substituting the inclusion in NPL 1 by the Nb-containing carbide, and thereby the maximum particle diameter Dmax is obtained as a value that corresponds to the $\sqrt{area_{max}}$ of NPL 1. The particle diameter of the respective particles referred herein is a square root of the area (projected area) of a particle observed in the cross sectional structure of the steel material observed with a microscope. The particle diameter can be obtained by analyzing the micrograph by a computer. The observation view field may be 100 $mm^2$, and the number of observation view fields may be 30 or more.

In the steel material having been subjected to a temper heat treatment, in the case where the maximum particle diameter Dmax of the Nb-containing carbide particles in $10^3$ $mm^3$ estimated by an extreme value statistics method (which may be hereinafter referred simply to the maximum particle diameter Dmax) is controlled to 18.0 μm or less, the fatigue characteristics that are sufficient from the standpoint of the prevention of fatigue failure of a high-strength member demanded to have abrasion resistance (for example, fatigue characteristics of a 600 HV tempered material that provide a fatigue limit of 800 $N/mm^2$, which is the maximum value of applied stress that provides the ratio of test specimens of 50% or more that do not broken under $10^7$ cycles under conditions of a frequency of 20 Hz and a stress ratio of −1) may be stably obtained. The Dmax is more preferably 16.5 μm or less, and further preferably 15.5 μm or less.

For sufficiently ensuring the abrasion resistance, on the other hand, it is effective to disperse a Nb-containing carbide having a particle diameter as large as approximately 1 μm. As a result of various investigations, excellent abrasion resistance may be achieved by making the structure state having a number of Nb-containing carbide particles having a particle diameter of 1.0 μm or more that is controlled to 200 particles per $mm^2$ or more. In the steel having the chemical composition determined in the invention, the number of Nb-containing carbide particles having a particle diameter of 1.0 μm or more may be controlled as above by preventing the heating temperature in the cast material heat treatment from becoming too high corresponding to the C content and the Nb content.

The matrix of the steel material (steel base material) according to the invention is a martensite structure or a martensite-ferrite structure for a quenched and tempered material, and is a bainite structure or a bainite-ferrite structure for an austempered material.

Manufacturing Process

The abrasion-resistant steel material according to the invention may be manufactured by a process containing casting, hot working, and a temper heat treatment. Examples of the hot working include hot rolling and hot forging. In the case where an abrasion-resistant member is obtained from a hot-rolled steel sheet as a raw material, a process containing casting, hot rolling, finish annealing, forming, and a temper heat treatment in this order may be employed, and in the case where a cold-rolled steel sheet is used as the raw material, a process containing casting, hot rolling, annealing, cold rolling, finish annealing, forming, and a temper heat treatment in this order may be employed. The process steps of the latter case as an example will be described below.

Casting

The Nb-containing carbide is precipitated by utilizing the cooling process after casting. At this time, it is important to control strictly the cooling rate on casting corresponding to the C content and the Nb content in the steel and the heating temperature in the cast material heat treatment performed in the subsequent step. Specifically, the casting condition is controlled in such a manner that the average cooling rate (° C. per minute) from 1,500° C. to 1,000° C. in the center portion of the cast material on casting is the G value determined by the following expression (1) or more:

$$G \text{ value} = 0.39 \exp(3.94x) \quad (1)$$

wherein $x = Nb - 10^y / C$ $y = 3.42 - 7{,}900/(T+273)$

C represents the C content (% by mass) in the steel, Nb represents the Nb content (% by mass) in the steel, and T represents the heating temperature (° C.) in the cast material heat treatment.

The G value of the expression (1) is an index of the acceptable lower limit (° C. per minute) of the average cooling rate from 1,500° C. to 1,000° C. on casting that is determined corresponding to the C content, the Nb content, and the heating temperature of the cast material in the cast material heat treatment performed in the subsequent step. The Nb-containing carbide becomes coarse with the larger average cooling rate of the center portion of the cast material, and in the case where the excessively coarse Nb-containing carbide is present in the cast material, the excessively large Nb-containing carbide particles, which become a starting point of fatigue failure, may remain even though the re-dissolution into the solid solution thereof is performed in the subsequent cast material heat treatment. In the case where the Nb content and the C content in the steel are larger, the Nb-containing carbide is liable to become coarse to increase the G value, and thus the acceptable lower limit of the cooling rate on casting that is necessary for the improvement of the fatigue characteristics is increased. On the other hand, the re-dissolution into the solid solution of the Nb-containing carbide proceeds with the higher heating temperature in the cast material heat treatment, the acceptable lower limit of the cooling rate on casting may be relaxed. Herein, x is an index of the extent of the remaining Nb-containing carbide having a particle diameter of 1 μm or more after the re-dissolution into the solid solution in a steel having a C content of from 0.30 to 0.90%.

Cast Material Heat Treatment

As the cast material heat treatment, a part of the Nb-containing carbide, which has been precipitated in the cast material, may re-dissolves into a solid solution by utilizing the heating operation of the cast material (representative examples of which include a continuously cast slab) performed on hot rolling. The cast material heating temperature on hot rolling (i.e., the maximum achieving temperature of the center portion of the cast material) is generally in a range of from 1,100 to 1,350° C., and in the invention, the heating temperature T of the steel material may be determined in the range. The heating retention time (i.e., the period of time where the temperature of the center portion of the steel material is in a range of (steel material heating temperature−20° C.) or more) may be from 30 to 300 minutes. The heating temperature T (° C.) in the cast material heat treatment is demanded to be determined corresponding to the C content and the Nb content in the steel in such a manner that the G value determined by the expression (1) is 0.53 or more, and more preferably 0.55 or more. In the case where the cast material is heated to a heating temperature T that provides a G value smaller than the above, there are cases where the dissolution into the solid solution of the Nb-containing carbide excessively proceeds, which is disadvantageous for imparting the abrasion resistance. Accordingly, it is important to determine the heating temperature T in the cast material heat treatment to make the suitable G value, and to control the casting condition based on the G value.

Hot Rolling

The hot rolling conditions may be, for example, a finish rolling temperature of from 800 to 900° C., and a winding temperature of 750° C. or less.

Annealing and Cold Rolling

The hot rolled sheet may be subjected to annealing and cold rolling depending on necessity to control the sheet to a target thickness. The annealing of the hot-rolled sheet may be performed under a condition of retaining heat to a temperature range of 600° C. or more and less than the $Ac_1$ point for a period of from 10 to 50 hours. The operation including annealing and cold rolling in this order may be performed multiple times. In this case, the intermediate annealing is also performed preferably by heating to a temperature range of 600° C. or more and less than the $Ac_1$ point.

Finish Annealing and Forming

The hot-rolled steel sheet or the cold-rolled steel sheet having been controlled to the prescribed thickness is subjected to finish annealing to provide a raw material steel sheet having a softened recrystallized ferrite structure (annealed structure). The finish annealing is necessarily performed in a temperature range of less than the $Ac_1$ point. For facilitating the recrystallization, the steel sheet is preferably heated to a temperature range of 600° C. or more and less than the $Ac_1$ point. The retention time may be determined to an optimum condition within a range of from 8 to 40 hours. The distribution state of the Nb-containing carbide in the steel material having been controlled through the cast material heat treatment is substantially maintained after the finish annealing. After the finish annealing, forming is performed into the shape of the member. The raw material steel sheet after the finish annealing has a cross sectional hardness in a range of approximately from 150 to 250 HV, and thus is sufficiently capable of being formed into the shape of the member.

Temper Heat Treatment

The member obtained by forming the raw material steel sheet into the shape of the member is subjected to a temper heat treatment, such as a quench and tempering treatment and an austempering treatment, so as to be tempered to, for example, from 500 to 650 HV. The solution temperature in the temper heat treatment is preferably in the austenite range and in a range of 1,000° C. or less. When the temperature exceeds the range, there is a possibility that the distribution state of the Nb-containing carbide having been controlled is broken. The temper heat treatment condition may be determined according to the ordinary measures except that the upper limit of the solution temperature is prevented from being excessively increased.

According to the procedures, a high-strength mechanical member having abrasion resistance and fatigue characteristics suitable for power transmission component and a cutting tool to high levels can be provided.

Example

Steels having the chemical compositions shown in Table 1 were produced, and a steel block of 30 kg for a melting and solidification experiment was cut out from the slab of each of the steels. The steel block was melted in a crucible to make a molten steel, which was then cooled under conditions of various cooling rates on solidification, so as to provide solidified blocks that simulated cast materials controlled in cooling rate on casting.

TABLE 1

| Class | Steel No. | Chemical composition (% by mass) C | Si | Mn | P | S | Cr | Ti | Nb | Other |
|---|---|---|---|---|---|---|---|---|---|---|
| comparative steel | A | 0.96 | 0.14 | 1.34 | 0.011 | 0.003 | 1.42 | — | 0.34 | — |
| | B | 0.27 | 0.26 | 0.44 | 0.013 | 0.003 | — | — | 0.12 | — |
| | C | 0.62 | 0.18 | 1.32 | 0.018 | 0.009 | — | — | 0.75 | — |
| | D | 0.58 | 0.35 | 0.78 | 0.015 | 0.008 | — | — | 0.07 | — |
| | E | 0.59 | 0.32 | 0.70 | 0.010 | 0.008 | — | — | — | — |
| | F | 0.54 | 0.24 | 0.82 | 0.010 | 0.012 | — | 0.23 | 0.28 | — |
| steel of invention | G | 0.50 | 0.20 | 0.75 | 0.010 | 0.003 | — | — | 0.35 | — |
| | H | 0.86 | 0.34 | 0.42 | 0.009 | 0.016 | — | — | 0.68 | — |
| | I | 0.56 | 0.94 | 0.62 | 0.015 | 0.013 | — | — | 0.54 | N: 1.19 |
| | J | 0.42 | 0.22 | 1.46 | 0.008 | 0.003 | 0.48 | — | 0.36 | V: 0.22 |
| | K | 0.32 | 0.24 | 0.65 | 0.011 | 0.018 | 1.48 | — | 0.39 | Mo: 0.20 |
| | L | 0.52 | 0.33 | 0.40 | 0.013 | 0.005 | — | 0.09 | 0.42 | B: 0.0030 |
| | M | 0.70 | 0.16 | 0.38 | 0.009 | 0.011 | — | — | 0.13 | — |
| | N | 0.33 | 0.20 | 0.28 | 0.008 | 0.015 | 1.50 | — | 0.33 | Mo: 0.24 |
| | O | 0.52 | 0.15 | 0.74 | 0.007 | 0.009 | 0.52 | — | 0.20 | — |
| | P | 0.65 | 0.20 | 0.28 | 0.008 | 0.015 | 1.20 | — | 0.39 | Mo: 0.22 |
| | Q | 0.63 | 0.18 | 1.25 | 0.007 | 0.003 | — | — | 0.25 | V: 0.25 |
| | R | 0.34 | 0.31 | 0.76 | 0.006 | 0.009 | 0.35 | — | 0.12 | — |

The underlined values are outside the scope of the invention.

FIG. 1 is an illustration schematically showing the structure of the melting and solidification apparatus used in the experiment. In a cylindrical crucible 2 disposed in a space surrounded by a heat insulating material 1, a molten steel 4 is obtained by melting the steel block with heat from a heater 3. The crucible 2 is disposed on an elevatable stage 6 through refractory bricks 5. From the state where the steel melting temperature of 1,700° C., the crucible 2 having the molten steel 4 therein was moved to a cooling zone equipped with a water cooling coil 7 by descending the stage 6, thereby solidifying the molten steel 4. At this time, the temperature of the molten steel 4 and a solidified matter formed by the solidification of the molten steel was monitored with a thermocouple 8 disposed at the center of the crucible 2, and the descending speed of the stage 6, the amount of heat from the heater 3, and the heat removal amount with the water cooling coil 7 were adjusted to control the average cooling rate from 1,500° C. to 1,000° C. to a prescribed value in a range of from 0.5 to 20° C. per minute. The solidified matter thus obtained simulated a cast material having a controlled cooling rate of the center portion of the cast material on casting. The solidified matter is hereinafter referred to as a simulated cast material, and the average cooling rate is assumed to be the average cooling rate from 1,500° C. to 1,000° C. in the center portion of the cast material on casting.

Manufacturing of Test Material

The simulated cast material was used as a raw material, and a test material having a thickness of 1.5 mm and a tempered hardness of 600±15 HV was manufactured through a process including hot rolling, annealing, cold rolling, finish annealing, and temper heat treatment in this order. The manufacturing conditions in the process steps were as follows.

Hot rolling: heating temperature of simulated cast material: 1,250 to 1,350° C. (see Table 2), heat retention time: 60 min, finish rolling temperature: 850° C., winding temperature: 550° C., thickness of hot-rolled sheet: 3.5 mm Annealing: 690° C. for 15 hours, thereafter the thickness controlled to 3.0 mm by cutting Cold rolling: original thickness: 3.0 mm, thickness of cold-rolled sheet: 1.5 mm Finish annealing: 670° C. for 15 hours Temper heat treatment: heat treatment at 820° C. for 15 min, then quenched in an oil bath at 60° C., thereafter tempered for 30 min at a temperature targeting tempered hardness of 600 HV corresponding to the composition Calculation of G Value For each of the test materials, the G value was calculated from the C content and the Nb content in the steel, and the heating temperature of the simulated cast material, according to the expression (1).

Observation of Structure

For each of the test materials, the cross sectional surface in parallel to the rolling direction and the thickness direction (L cross sectional surface) was observed with an optical microscope, and thereby the maximum particle diameter Dmax of the Nb-containing carbide particles in $10^3$ $mm^3$ estimated by an extreme value statistics method (as described above). The statistical process according to NPL 1 was performed by substituting the inclusion in NPL 1 by the Nb-containing carbide, and thereby the maximum particle diameter Dmax was obtained as a value that corresponded to the $\sqrt{area_{max}}$ of NPL 1. The measurement conditions were as follows.

Measurement apparatus: optical microscope (observation magnification: 100 to 1,000

Inspection standard area $S_0$: 100 $mm^2$

Number of inspection n: 30

Estimated volume V: 1,000 $mm^3$

For each of the test materials, the L cross sectional surface was observed with an analytical scanning electron microscope, and the number of Nb-containing carbide particles having a particle diameter of 1.0 μm or more in the carbide particles present in 20 view fields with an observation area of 61×61 $\mu m^2$, and was converted to the number per 1 $mm^2$. The particle diameter was a square root of the area of the particle, and the particles having a particle diameter of 1.0 μm or more were counted by image analysis.

Abrasion Resistance Test

A test piece having a frictional surface in the form of square having an edge length of 1.5 mm was cut out from the test material, and subjected to a test with a pin-on-disk abrasion tester. The counter material for abrasion was a VC (vanadium carbide) film formed on a flat surface of a steel sheet by a salt bath treatment. The hardness of the film corresponds to approximately 2,400 HV. The test piece was fixed to a test piece holder and subjected to an abrasion test under conditions of a frictional speed of 1 m/sec and a frictional length L of 3,600 m while pressing the surface of the test piece onto the rotating counter material for abrasion under a test load F of 500 N. The volume of the material that was lost through abrasion was calculated from the difference in the thickness of the test piece between before and after the test, and was designated as the abrasion loss W ($mm^3$). The specific abrasion amount C ($mm^3$/Nm) was obtained by the following expression (2).

$$\text{specific abrasion amount } C = \text{abrasion loss } W/(\text{test load } F \times \text{frictional length } L) \quad (2)$$

For a material having a tempered hardness of 600 HV, in the case where the specific abrasion amount C is $0.35\times10^{-7}$ $mm^3$/Nm or less, the material is evaluated as having excellent abrasion resistance, as compared to the currently used steel used in a power transmission component and a cutting tool formed of a steel having a C content of 0.90% or less. Accordingly, the specimen that had a specific abrasion amount C of $0.35\times10^{-7}$ $mm^3$/Nm or less was designated as passed (good abrasion resistance).

Fatigue Test

Fatigue test pieces each having the shape shown in FIG. 2 (having a thickness of 1.5 mm and the longitudinal direction that agreed with the rolling direction) were produced from the test material, and subjected to a test with a hydraulic servo fatigue tester under conditions of a frequency of 20 Hz and a stress ratio of −1 at an applied stress of from 800 N/$mm^2$ to 1,000 N/$mm^2$ with an interval of 50 N/$mm^2$ for 10 test pieces for each of the stress values, i.e., for 50 test pieces in total. The maximum applied stress where the majority of the test pieces did not broken until $10^7$ cycles was designated as the fatigue limit of the test material.

The results are shown in Table 2. In Table 2, the cast material cooling rate means the average cooling rate from 1,500° C. to 1,000° C. in the center portion of the simulated cast material, and the number of particles of 1.0 μm or more means the number of the Nb-carbide particles having a particle diameter of 1.0 μm or more.

TABLE 2

| Test No. | Steel | Cast material heating temperature T (° C.) | G value | Cast material cooling rate (° C./min) | Number of particles of 1.0 μm or more (per mm2) | Dmax (μm) | Specific abrasion amount ($\times10^{-7}$ $mm^3$/Nm) | Fatigue limit (N/$mm^2$) | Note |
|---|---|---|---|---|---|---|---|---|---|
| 1 | A | 1250 | 1.39 | 20 | 422 | 11.1 | 0.19 | 800 * | comparison |
| 2 | | 1250 | 1.39 | 10 | 440 | 12.2 | 0.18 | 800 * | comparison |
| 3 | | 1250 | 1.39 | 3 | 693 | 16.0 | 0.21 | 800 * | comparison |

TABLE 2-continued

| Test No. | Steel | Cast material heating temperature T (° C.) | G value | Cast material cooling rate (° C./min) | Number of particles of 1.0 μm or more (per mm2) | Dmax (μm) | Specific abrasion amount ($\times 10^{-7}$ $mm^3/Nm$) | Fatigue limit ($N/mm^2$) | Note |
|---|---|---|---|---|---|---|---|---|---|
| 4 | B | 1250 | 0.49 | 5 | 174 | 9.2 | 0.38* | 900 | comparison |
| 5 | C | 1250 | 6.72 | 20 | 1211 | 21.2 | 0.17 | <800 * | comparison |
| 6 | | 1250 | 6.72 | 10 | 1420 | 24.3 | 0.19 | <800 * | comparison |
| 7 | D | 1250 | 0.46 | 5 | 189 | 8.2 | 0.37* | 900 | comparison |
| 8 | E | 1250 | — | 2 | — | — | 0.44* | 800 | comparison |
| 9 | F | 1250 | 1.04 | 20 | 1580 | 22.0 | 0.18 | <800 * | comparison |
| 10 | | 1250 | 1.04 | 5 | 1631 | 24.2 | 0.18 | <800 * | comparison |
| 11 | G | 1250 | 1.35 | 3 | 588 | 11.2 | 0.18 | 950 | invention |
| 12 | | 1250 | 1.35 | 2 | 623 | 14.8 | 0.19 | 900 | invention |
| 13 | | 1250 | 1.35 | 1.5 | 792 | 16.4 | 0.22 | 850 | invention |
| 14 | | 1250 | 1.35 | 1 | 992 | 18.3 | 0.20 | <800 * | comparison |
| 15 | | 1250 | 1.35 | 0.5 | 889 | 20.2 | 0.22 | <800 * | comparison |
| 16 | H | 1250 | 5.26 | 7 | 1312 | 15.1 | 0.17 | 850 | invention |
| 17 | | 1250 | 5.26 | 6 | 1288 | 16.4 | 0.17 | 800 | invention |
| 18 | | 1250 | 5.26 | 5 | 1254 | 19.2 | 0.19 | <800 * | comparison |
| 19 | | 1250 | 5.26 | 4 | 1240 | 19.3 | 0.16 | <800 * | comparison |
| 20 | | 1350 | 4.83 | 5 | 1122 | 17.1 | 0.17 | 850 | invention |
| 21 | I | 1250 | 2.90 | 5 | 1182 | 13.4 | 0.19 | 900 | invention |
| 22 | | 1250 | 2.90 | 3 | 1241 | 15.2 | 0.20 | 850 | invention |
| 23 | | 1250 | 2.90 | 2 | 1084 | 18.8 | 0.17 | <800 * | comparison |
| 24 | | 1250 | 2.90 | 1 | 1129 | 22.3 | 0.19 | <800 * | comparison |
| 25 | J | 1250 | 1.37 | 3 | 543 | 10.9 | 0.22 | 900 | invention |
| 26 | | 1250 | 1.37 | 2 | 679 | 15.9 | 0.22 | 800 | invention |
| 27 | | 1250 | 1.37 | 1 | 792 | 18.5 | 0.23 | <800 * | comparison |
| 28 | K | 1250 | 1.47 | 3 | 581 | 11.9 | 0.26 | 850 | invention |
| 29 | | 1250 | 1.47 | 2 | 672 | 15.8 | 0.28 | 850 | invention |
| 30 | | 1250 | 1.47 | 1 | 811 | 19.1 | 0.24 | <800 * | comparison |
| 31 | L | 1250 | 1.79 | 3 | 627 | 11.7 | 0.23 | 900 | invention |
| 32 | | 1250 | 1.79 | 2 | 846 | 16.3 | 0.19 | 800 | invention |
| 33 | | 1250 | 1.79 | 1 | 828 | 18.4 | 0.22 | <800 * | comparison |
| 34 | M | 1250 | 0.59 | 2 | 245 | 13.2 | 0.32 | 900 | invention |
| 35 | | 1250 | 0.59 | 0.5 | 218 | 18.2 | 0.33 | <800 * | comparison |
| 36 | N | 1250 | 1.17 | 1 | 390 | 18.9 | 0.22 | <800 * | comparison |
| 37 | | 1350 | 0.93 | 1 | 429 | 16.7 | 0.22 | 850 | invention |
| 38 | O | 1250 | 0.75 | 1 | 355 | 17.1 | 0.26 | 800 | invention |
| 39 | | 1250 | 0.75 | 0.5 | 342 | 19.2 | 0.24 | <800 * | comparison |
| 40 | P | 1250 | 1.63 | 1.5 | 840 | 20.1 | 0.19 | <800 * | comparison |
| 41 | | 1350 | 1.46 | 1.5 | 711 | 17.4 | 0.21 | 800 | invention |
| 42 | Q | 1250 | 0.94 | 1.5 | 414 | 14.8 | 0.23 | 900 | invention |
| 43 | | 1250 | 0.94 | 0.5 | 385 | 18.9 | 0.19 | <800 * | comparison |
| 44 | R | 1250 | 0.51 | 3 | 185 | 9.2 | 0.36* | 900 | comparison |
| 45 | | 1200 | 0.55 | 3 | 218 | 10.4 | 0.34 | 900 | invention |

The underlined values are outside the scope of the invention.
* insufficient characteristics It was understood from Table 2 that the specimens according to the invention were produced where the heating temperature T in the cast material heat treatment was determined to make the G value of the expression (1) of 0.53 or more, and the cooling rate (° C./min) from 1,500° C. to 1,000° C. in the center portion of the simulated cast material was the G value or more, and thereby were controlled to have the number of the Nb-containing carbide having a particle diameter of 1.0 μm or more that was 200 particles per $mm^2$ or more, and the maximum diameter Dmax of the Nb-containing carbide particles in $10^3$ $mm^3$ estimated by an extreme value statistics method that was 18.0 μm or less. As a result, the fatigue characteristics were stably improved for the temper heat-treated material having excellent abrasion resistance.

On the other hand, in Nos. 1 to 3 as comparative examples, coarse iron eutectic carbide was formed on casting (casting of the simulated cast material) due to the excessive C content thereof, and functioned as a starting point of fatigue failure to deteriorate the fatigue characteristics. No. 4 was short in C content of the steel, and No. 7 was short in Nb content of the steel, due to which the number of the Nb-containing carbide having a particle diameter of 1.0 μm or more was short, and the abrasion resistance was inferior. In Nos. 5 and 6, the excessively large Nb carbide remained due to the excessive Nb content of the steel, and functioned as a starting point of fatigue failure to deteriorate the fatigue characteristics. No. 8 was inferior in abrasion resistance due to the steel that contained no Nb. In Nos. 9 and 10, an excessively large Ti-containing carbide was formed due to the excessively large Ti content of the steel, and functioned as a starting point of fatigue failure to deteriorate the fatigue characteristics. In No. 44, the heating temperature in the cast material heat treatment was determined to a temperature that provided a G value of less than 0.53, and thus the re-formation of the Nb-containing carbide to a solid solution proceeded excessively to make the improvement in abrasion resistance insufficient. The other comparative specimens than those described above each used a steel having a chemical composition determined in the invention, but Dmax exceeded 18.0 μm due to the cast material cooling rate that was less than the G value. In these comparative specimens, an excessively large Nb-containing carbide formed functioned as a starting point of fatigue failure to fail to improve the fatigue characteristics.

REFERENCE SIGNS LIST

1 heat insulating material
2 crucible
3 heater
4 molten steel
5 refractory brick
6 stage
7 water cooling coil
8 thermocouple

The invention claimed is:

1. An abrasion-resistant steel material excellent in fatigue characteristics having a chemical composition comprising from 0.30 to 0.90% of C, from 0.05 to 1.00% of Si, from 0.10 to 1.50% of Mn, from 0.003 to 0.030% of P, from 0.001 to 0.020% of S, and from 0.10 to 0.70% of Nb, all in terms of percentage by mass, with the balance of Fe and unavoidable impurities; having a metallic structure after a temper heat treatment having a Nb-containing carbide dispersed therein; and having a number of Nb-containing carbide particles having a particle diameter of 1.0 μm or more that is controlled to 200 particles per $mm^2$ or more, and a maximum particle diameter Dmax of Nb-containing carbide particles in $10^3$ $mm^3$ estimated by an extreme value statistics method that is controlled to 18.0 μm or less, assuming that a square root of an area of each of Nb-containing carbide particles found by observing a cross sectional structure is designated as the particle diameter of the particle.

2. The abrasion-resistant steel material excellent in fatigue characteristics according to claim 1, wherein the abrasion-resistant steel material has the chemical composition further containing one or more kind of 1.50% or less of Cr, 0.50% or less of Mo, 0.50% or less of V, 2.00% or less of Ni, 0.10% or less of Ti, and 0.0050% or less of B.

3. A method for manufacturing an abrasion-resistant steel material according to claim 1 excellent in fatigue characteristics, comprising providing an abrasion-resistant steel material having been finally subjected to a temper heat treatment from a steel material having been subjected to casting and a cast material heat treatment, in which a heating temperature T (° C.) in the cast material heat treatment is determined corresponding to a C content and a Nb-content in the steel in such a manner that a G value determined by the following expression (1) is 0.53 or more, and a casting condition is controlled in such a manner that an average cooling rate (° C. per minute) from 1,500° C. to 1,000° C. in a center portion of the cast material on casting is the G value or more:

$$G\ \text{value}=0.39\ \exp(3.94x) \quad (1)$$

wherein $x=Nb-10^y/C$ $y=3.42-7{,}900/(T+273)$

C represents the C content (% by mass) in the steel, Nb represents the Nb content (% by mass) in the steel, and T represents the heating temperature (° C.) in the cast material heat treatment.

* * * * *